US011418889B2

(12) United States Patent
Sun et al.

(10) Patent No.: US 11,418,889 B2
(45) Date of Patent: Aug. 16, 2022

(54) BACK PLATE AND MEMS MICROPHONE HAVING THE SAME

(71) Applicant: DB HITEK CO., LTD., Seoul (KR)

(72) Inventors: Jong Won Sun, Gyeonggi-do (KR); Han Choon Lee, Seoul (KR); Kum Jae Shin, Daegu (KR)

(73) Assignee: DB Hitek Co., LTD., Seoul (KR)

( * ) Notice: Subject to any disclaimer, the term of this patent is extended or adjusted under 35 U.S.C. 154(b) by 70 days.

(21) Appl. No.: 16/803,320

(22) Filed: Feb. 27, 2020

(65) Prior Publication Data

US 2020/0280808 A1 Sep. 3, 2020

(30) Foreign Application Priority Data

Feb. 28, 2019 (KR) ..... 10-2019-0024407

(51) Int. Cl.

| | |
|---|---|
| ***H04R 19/04*** | (2006.01) |
| ***H04R 1/04*** | (2006.01) |
| ***H04R 7/16*** | (2006.01) |
| ***H04R 7/04*** | (2006.01) |

(52) U.S. Cl.

CPC ..... *H04R 19/04* (2013.01); *H04R 1/04* (2013.01); *H04R 7/04* (2013.01); *H04R 7/16* (2013.01); *H04R 2201/003* (2013.01)

(58) Field of Classification Search

CPC ... H04R 1/04; H04R 7/18; H04R 7/20; H04R 19/005; H04R 19/016; H04R 19/04; H04R 31/003; H04R 31/006; H04R 7/04; H04R 2201/003; B81B 2201/0257; B81B 7/0032; B81B 7/002; B81C 1/00039; B81C 1/0039; B81C 1/00047; B81C 2201/00257; B81C 2203/0307; B81C 2203/0315

USPC ..... 381/113, 116, 174, 175, 190, 369

See application file for complete search history.

(56) References Cited

U.S. PATENT DOCUMENTS

2010/0254560 A1* 10/2010 Mehregany ..... H04R 19/005 381/361
2014/0270271 A1* 9/2014 Dehe ..... B81B 3/0018 381/174
2016/0112809 A1* 4/2016 Zinn ..... H04R 19/04 381/174
2017/0311088 A1* 10/2017 Sun ..... H04R 19/04

* cited by examiner

*Primary Examiner* — Alexander Krzystan
*Assistant Examiner* — Julie X Dang
(74) *Attorney, Agent, or Firm* — Patterson Thuente Pedersen, P.A.

(57) ABSTRACT

A back plate is disposed in a vibration area of a MEMS microphone. The back plate includes a central area located at a central portion of the back plate and having a plurality of acoustic holes formed therein, and a peripheral area located to surround the central area. The acoustic holes are arranged to be spaced apart from each other by the same interval.

17 Claims, 24 Drawing Sheets

BACK PLATE AND MEMS MICROPHONE HAVING THE SAME

CROSS-REFERENCE TO RELATED APPLICATION

This application claims priority, and all the benefits accruing therefrom under 35 U.S.C. § 119, to Korean Patent Application No. 10-2019-0024407, filed on Feb. 28, 2019, the contents of which are incorporated by reference in their entirety.

TECHNICAL FIELD

The present disclosure relates to back plates and Micro-Electro-Mechanical Systems (MEMS) microphones having the same, and more particularly, to back plates disposed to face a diaphragm in a MEMS microphone and a MEMS microphone having the same.

BACKGROUND

Generally, a capacitive microphone utilizes the capacitance between a pair of electrodes that are facing each other to generate an acoustic signal. A MEMS microphone may be manufactured by a semiconductor MEMS process to have an ultra-small size.

A MEMS microphone may include a substrate including a cavity, a bendable diaphragm and a back plate which is facing the diaphragm. The diaphragm is spaced apart from the substrate and the back plate so that the diaphragm can be freely bent upwardly and downwardly. The diaphragm can be a membrane structure to generate a displacement due to an acoustic pressure. In particular, when the acoustic pressure reaches to the diaphragm, the diaphragm may be bent upwardly or downwardly due to the acoustic pressure. The displacement of the diaphragm can be sensed through a change of capacitance between the diaphragm and the back plate. As a result, an acoustic wave can be converted into an electrical signal for output.

In order to apply the MEMS microphone to a mobile device such as a mobile phone, the signal-to-noise ratio (SNR) of the MEMS microphone must be improved. The SNR may be improved by adjusting the size and shape of acoustic holes formed in the back plate.

In a conventional example, the acoustic holes may have a circular shape and may be arranged in a honeycomb shape. When the acoustic holes have such a structure, the acoustic holes are not spaced apart from each other by the same interval. In particular, there is a portion where the intervals between the acoustic holes are relatively wide and a portion where the intervals between the acoustic holes are relatively narrow. This arrangement of acoustic holes may not be optimal.

SUMMARY

Embodiments of the present disclosure provide a MEMS microphone, and a back plate thereof, having a relatively large area of acoustic holes in order to improve SNR.

According to an example embodiment of the present disclosure, a back plate disposed in a vibration area of a MEMS microphone includes a central area located at a central portion of the back plate and having a plurality of acoustic holes formed therein, and a peripheral area located to surround the central area. The acoustic holes are arranged to be spaced apart from each other by equal intervals.

In an embodiment, the plurality of acoustic holes have the same size as each other and each of the plurality of acoustic holes has a shape selected from the group consisting of: a rhomboid shape, an regular triangular shape, a regular hexagonal shape, a regular square shape, and a right triangular shape.

In an embodiment, the plurality of acoustic holes each have a rhomboid shape or a regular square shape and the plurality of acoustic holes are spaced in a lattice arrangement.

In an embodiment, the plurality of acoustic holes each have a regular hexagonal shape and the plurality of acoustic holes are spaced in a honeycomb arrangement.

In an embodiment, the plurality of acoustic holes comprises at least six acoustic holes, each having a regular triangular shape and the plurality of acoustic holes are arranged such that each group of six adjacent acoustic holes are spaced in an approximately regular hexagonal arrangement.

In an embodiment, the plurality of acoustic holes each have a right triangular shape and two adjacent acoustic holes are spaced in an approximately regular square arrangement.

In an embodiment, the plurality of acoustic holes comprise at least three first acoustic holes each having a regular hexagonal shape and a plurality of second acoustic holes each having a regular triangular shape, each of the second acoustic holes being disposed among three adjacent first acoustic holes.

In an embodiment, the central area is radially and equally divided with respect to a center of the central area into a plurality of segments such that a portion of the plurality of acoustic holes is arranged in each of the plurality of segments. The portion of the plurality of acoustic holes disposed in each segment has an arrangement that is rotationally symmetrical with respect to the center relative to the other portions of the plurality of acoustic holes.

In an embodiment, the central area is divided into three segments, the plurality of acoustic holes have the same size as each other, and each of the plurality of acoustic holes has at least one shape selected from the group consisting of: a rhomboid shape, a regular triangular shape, and a regular hexagonal shape.

In an embodiment, the central area is divided into three segments, and each of the plurality of acoustic holes has a regular hexagonal shape or a regular triangular shape.

In an embodiment, the central area is divided into two segments or four segments, the plurality of acoustic holes have the same size as each other, and each of the plurality of acoustic holes has a regular square shape or a right triangular shape.

In an embodiment, the central area further includes a plurality of support areas radially extending from a center of the central area to the peripheral area to equally divide the central area, the plurality of support areas having a width wider than an interval between the plurality of acoustic holes to prevent sagging of the central area, and a plurality of hole areas divided equally by the plurality of support areas and in which the plurality of acoustic holes are disposed.

In an embodiment, the back plate further comprises second acoustic holes formed in the support areas. In an embodiment, a size of the second acoustic holes is equal to or smaller than a size of the plurality of acoustic holes.

In an embodiment, an interval between the second acoustic holes and an interval between the plurality of acoustic holes and the second acoustic holes are equal to or wider than the interval between the plurality of acoustic holes.

In an embodiment, arrangements of the plurality of acoustic holes disposed in each of the plurality of hole areas are symmetrical with respect to the center of the central area.

In an embodiment, the plurality of support areas are arranged to form an angle of 120 degrees to each other, the plurality of acoustic holes have the same size as each other, and the plurality of acoustic holes each have a shape selected from the group consisting of: a rhomboid shape, a regular triangular shape, and a regular hexagonal shape.

In an embodiment, the plurality of support areas are arranged to form an angle of 120 degrees to each other, and each of the plurality of acoustic holes has a regular hexagonal shape or a regular triangular shape.

In an embodiment, the plurality of support areas are arranged to form an angle of 90 degrees or 180 degrees to each other, the plurality of acoustic holes have the same size as each other, and each of the plurality of acoustic holes has a regular square shape or a right triangular shape.

In an embodiment, a Micro-Electro-Mechanical Systems (MEMS) microphone comprises a substrate presenting a vibration area, a supporting area surrounding the vibration area and a peripheral area surrounding the supporting area, the substrate defining a cavity formed in the vibration area, a diaphragm disposed in the vibration area, being spaced apart from the substrate, covering the cavity, and configured to generate a displacement thereof in response to an applied acoustic pressure, and a back plate disposed over the diaphragm in the vibration area, the back plate being spaced apart from the diaphragm such that an air gap is maintained between the back plate and the diaphragm, and defining a plurality of acoustic holes. The back plate includes a central area located at a central portion of the back plate, the plurality of acoustic holes formed in the central area, and a second peripheral area located to surround the central area, wherein the plurality of acoustic holes are arranged to be spaced apart from each other by the same interval.

According to example embodiments of the present disclosure as described above, because the acoustic holes of the back plate are arranged to be spaced apart from each other by the same interval, the area between the acoustic holes may be minimized. Therefore, the area of the acoustic holes may be increased in the total area of the central area. In particular, when the acoustic holes have the same size as each other, the area of the acoustic holes may be further relatively increased.

In addition, because the acoustic holes are arranged to be symmetric with respect to the center, sagging of the central area may be radially uniform with respect to the center even if the sagging of the central area occurs due to the acoustic holes. Accordingly, the diaphragm disposed to face the back plate may also vibrate uniformly radially with respect to the center.

In addition, since widths of the support areas are wider than the intervals between the acoustic holes, the support areas may stably support the center area. Therefore, even if the acoustic holes are formed in the central area, the sagging of the central area may be prevented.

According to embodiments of the present disclosure, since an area of the acoustic holes is relatively increased in a total area of the back plate, the SNR of the MEMS microphone may be improved.

BRIEF DESCRIPTION OF THE DRAWINGS

Example embodiments can be understood in more detail from the following description taken in conjunction with the accompanying drawings, in which.

Figure 1:
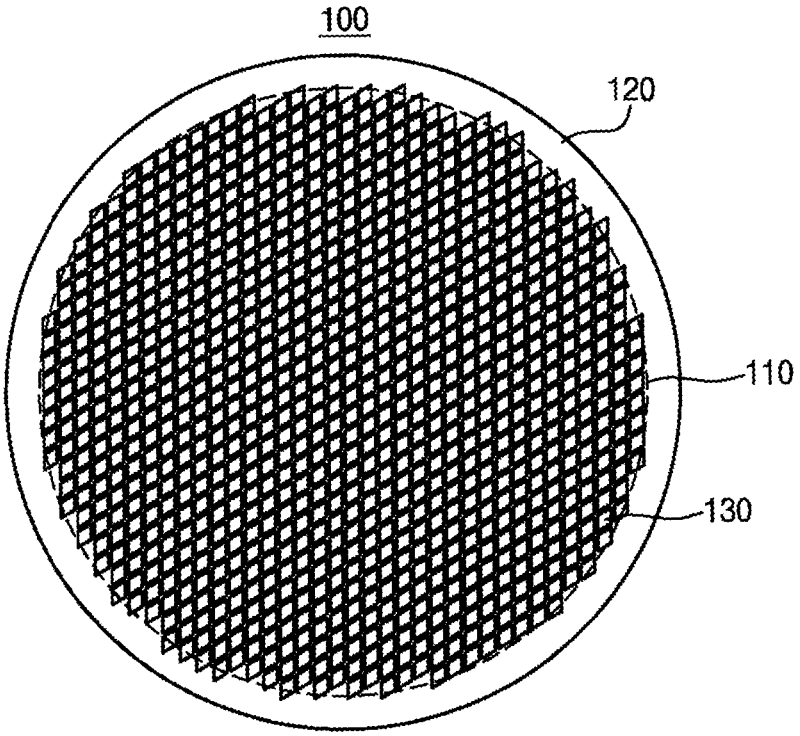
FIG. 1 is a plan view illustrating a back plate in accordance with an example embodiment of the present disclosure.

While various embodiments are amenable to various modifications and alternative forms, specifics thereof have been shown by way of example in the drawings and will be described in detail. It should be understood, however, that the intention is not to limit the claimed inventions to the particular embodiments described. On the contrary, the intention is to cover all modifications, equivalents, and alternatives falling within the spirit and scope of the subject matter as defined by the claims.

DETAILED DESCRIPTION

Hereinafter, specific embodiments will be described in more detail with reference to the accompanying drawings. The present invention may, however, be embodied in different forms and should not be construed as limited to the embodiments set forth herein.

As an explicit definition used in this application, when a layer, a film, a region or a plate is referred to as being 'on' another one, it can be directly on the other one, or one or more intervening layers, films, regions or plates may also be present. By contrast, it will also be understood that when a layer, a film, a region or a plate is referred to as being 'directly on' another one, it is directly on the other one, and one or more intervening layers, films, regions or plates do not exist. Also, although terms such as a first, a second, and a third are used to describe various components, compositions, regions, films, and layers in various embodiments of the present disclosure, such elements are not limited to these terms.

Furthermore, and solely for convenience of description, elements may be referred to as "above" or "below" one another. It will be understood that such description refers to the orientation shown in the Figure being described, and that in various uses and alternative embodiments these elements could be rotated or transposed in alternative arrangements and configurations.

In the following description, the technical terms are used only for explaining specific embodiments while not limiting the scope of the present disclosure. Unless otherwise defined herein, all the terms used herein, which include technical or scientific terms, may have the same meaning that is generally understood by those skilled in the art.

The depicted embodiments are described with reference to schematic diagrams of some embodiments of the present disclosure. Accordingly, changes in the shapes of the diagrams, in an example embodiment, changes in manufacturing techniques and/or allowable errors, are sufficiently expected. The Figures are not necessarily drawn to scale. Accordingly, embodiments of the present disclosure are not described as being limited to specific shapes of areas described with diagrams and include deviations in the shapes and also the areas described with drawings are entirely schematic and their shapes do not represent accurate shapes and also do not limit the scope of the present disclosure.

Figure 2:
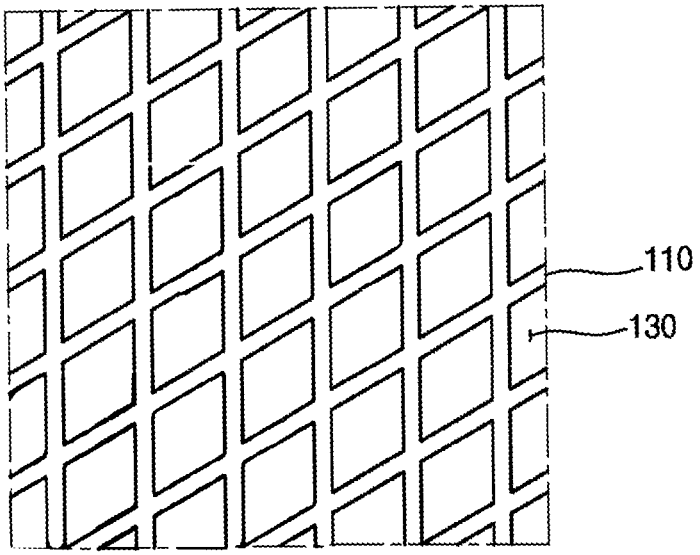
FIG. 2 is an enlarged view illustrating the central area of the back plate shown in FIG. 1, according to an embodiment.
Figure 12:
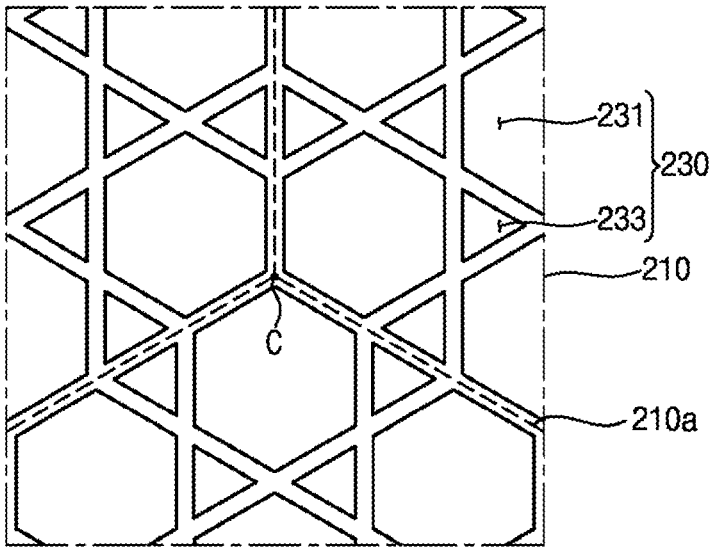

FIG. 1 is a plan view illustrating a back plate in accordance with an example embodiment of the present disclosure, FIG. 2 is an enlarged view illustrating the central area of the back plate shown in FIG. 1, and FIGS. 3 to 7 are enlarged views illustrating alternate embodiments of the central area of the back plate shown in FIG. 12.

Referring to FIGS. 1 to 7, a back plate 100 is disposed in a vibration area of a Micro-Electro-Mechanical Systems (MEMS) microphone. The back plate 100 may be disposed to face a diaphragm. In an example embodiment, the back plate 100 may be substantially disc shaped.

The back plate 100 may be divided into a central area 110 and a peripheral area 120.

The central area 110 is located at a central portion of the back plate 100 and can have a substantially circular shape.

The peripheral area 120 includes an area of the back plate 100 except for the central area 110 and can have a ring shape surrounding the central area 110.

A plurality of acoustic holes 130 are formed by penetrating through the central area 110 in a vertical direction. Each of acoustic holes 130, therefore, can be an aperture defined by perforations through central area 110. As discussed herein, the shape and size of holes can refer to the shape and sides of walls defining said holes. The acoustic holes 130 may be spaced apart from each other by the same interval.

Referring to FIG. 2, in an example embodiment, the acoustic holes 130 may have a rhomboid shape and may have the same size, or area, as each other. In embodiments, the opposite angles of the rhomboid acoustic holes 130 are preferably 60 degrees and 120 degrees, though other angles can be used.

The acoustic holes 130 may be arranged to form a lattice shape. As depicted in FIG. 2, the acoustic holes 130 may be arranged at the same angles as the opposite angles of the acoustic holes 130.

Figure 3:
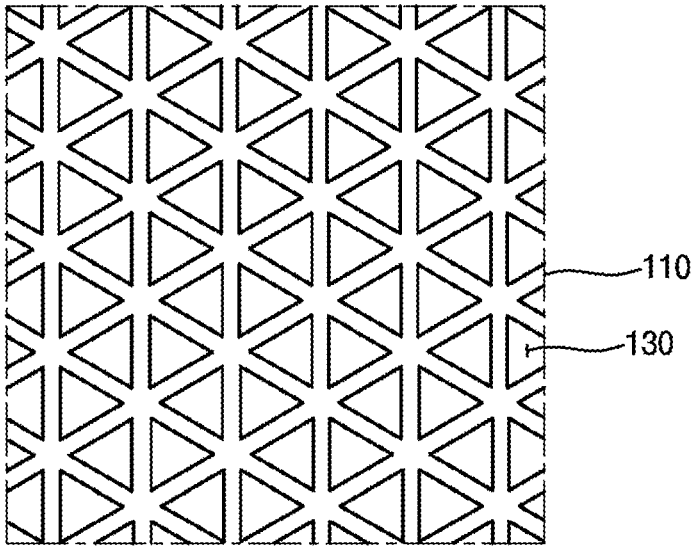
FIGS. 3 to 7 are enlarged views illustrating alternate embodiments of the central area of the back plate shown in FIG. 1.

Referring to FIG. 3, the acoustic holes 130 may have a regular triangular shape and may have the same size as each other. When the acoustic holes 130 have a regular triangular shape, six adjacent acoustic holes 130 may be arranged to form a substantially hexagonal shape.

Figure 4:
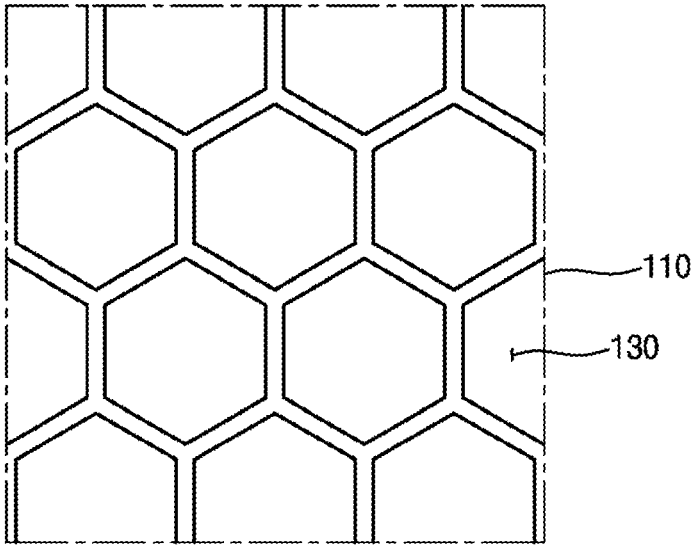

Referring to FIG. 4, the acoustic holes 130 may have a regular hexagonal shape and may have the same size as each other. When the acoustic holes 130 have a regular hexagonal shape, the acoustic holes 130 may be arranged to form a honeycomb shape.

Figure 5:
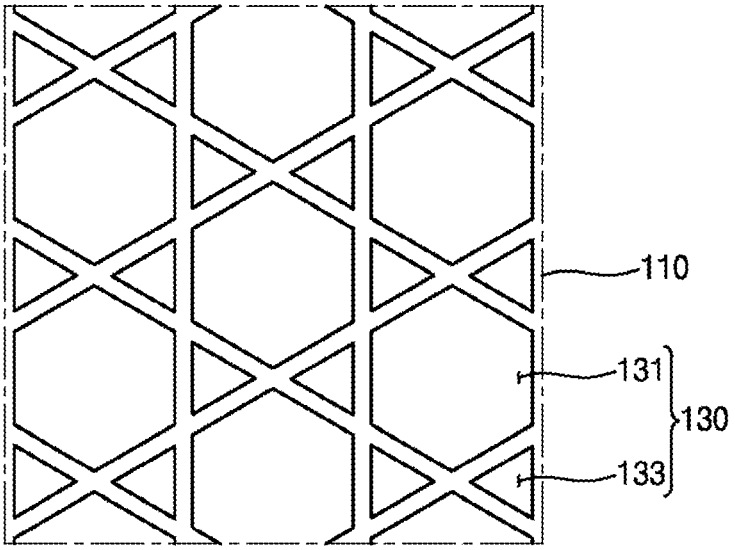

Referring to FIG. 5, the acoustic holes 130 may include both holes 131 having regular hexagonal shapes and holes 133 having regular triangular shapes. The regular hexagonal holes 131 may have the same size as each other, and the regular triangle-shaped holes 133 may have the same size as each other. The regular hexagonal holes 131 and the regular triangle-shaped holes 133 may have different sizes.

The regular hexagonal holes 131 may be disposed so that vertices of the regular hexagonal holes 131 are adjacent to each other, and one regular triangular hole 133 may be disposed among three adjacent regular hexagonal holes 131.

Figure 6:
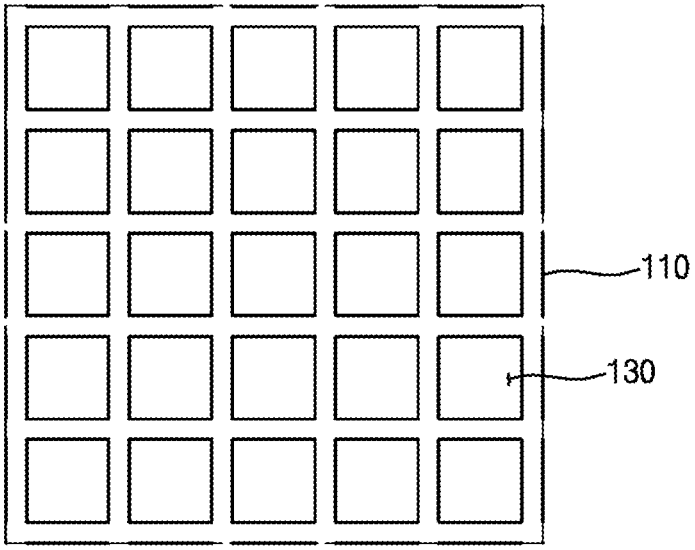

Referring to FIG. 6, the acoustic holes 130 may have a regular square shape and may have the same size as each other. The acoustic holes 130 may be arranged to form a lattice shape.

Figure 7:
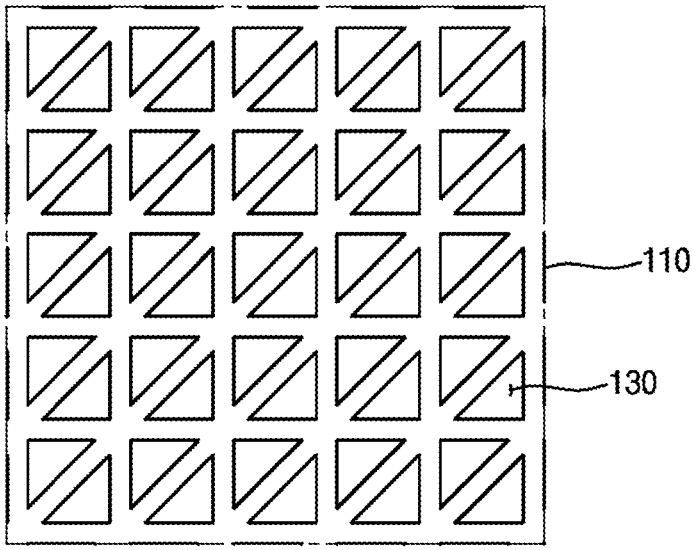

Referring to FIG. 7, the acoustic holes 130 may have a right triangular shape and may have the same size as each other. When the acoustic holes 130 have a right triangular shape, two adjacent acoustic holes 130 may be disposed to form a substantially regular square shape.

As illustrated in FIGS. 1 to 7, the acoustic holes 130 are disposed to be spaced apart by the same interval from each other, thereby an area between the acoustic holes 130 may be minimized. Therefore, an area of the acoustic holes 130 may be increased in the total area of the central area 110 as compared with conventional arrangements. As the area of the acoustic holes 130 is increased, the signal-to-noise ratio (SNR) of the MEMS microphone including the back plate 100 may be improved.

Figure 8:
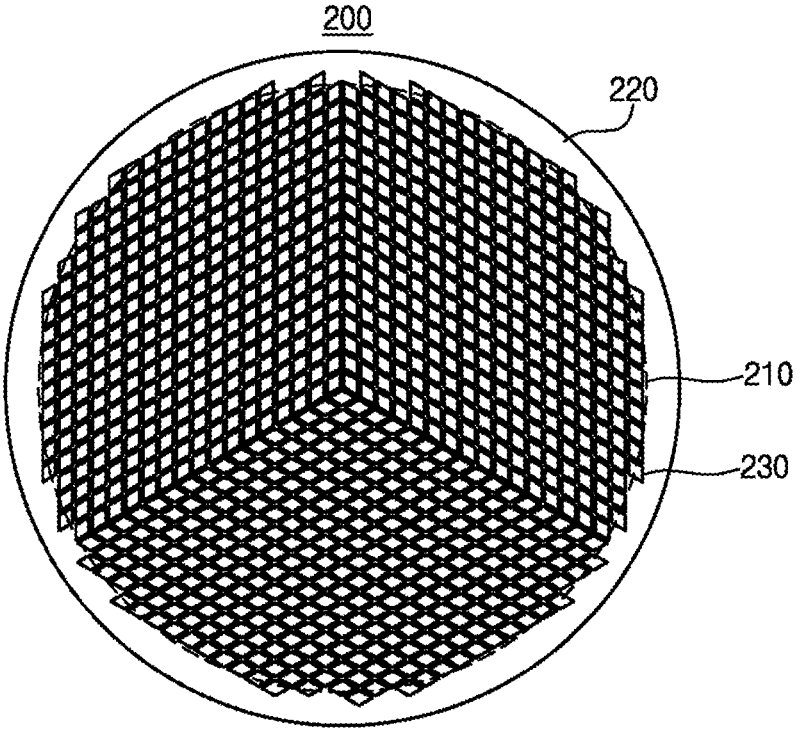
FIG. 8 is a plan view illustrating a back plate in accordance with another example embodiment of the present disclosure.
Figure 9:
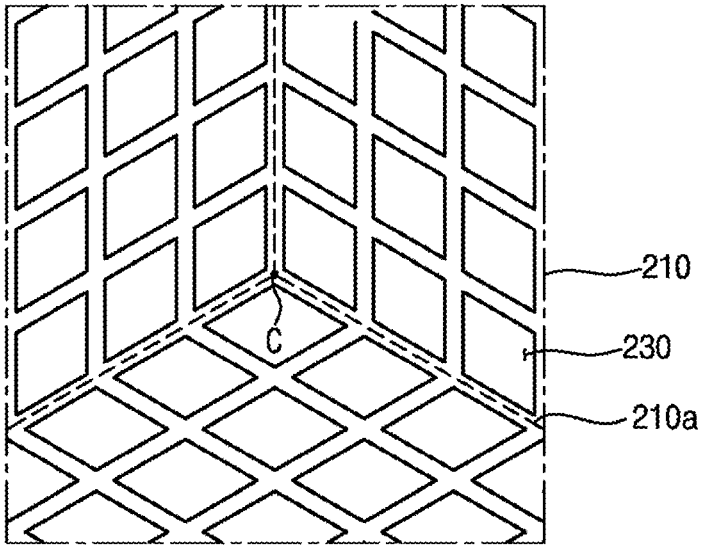
FIG. 9 is an enlarged view illustrating the central area of the back plate shown in FIG. 8, according to an embodiment.

FIG. 8 is a plan view illustrating a back plate in accordance with another example embodiment of the present disclosure, FIG. 9 is an enlarged view illustrating one embodiment central area of the back plate shown in FIG. 8, and FIGS. 10 to 16 are enlarged views illustrating alternate embodiments of the central area of the back plate shown in FIG. 8.

Referring to FIGS. 8 to 16, a back plate 200 is disposed in a vibration area of a MEMS microphone. The back plate 200 may be disposed to face a diaphragm. In an example embodiment, the back plate 200 may be substantially disc shaped.

The back plate 200 may be divided into a central area 210 and a peripheral area 220. The central area 210 is located at a central portion of the back plate 200 and has a substantially circular shape. The peripheral area 220 includes an area of the back plate 200 except for the central area 210 and has a ring shape surrounding the central area 210.

Dividing lines 210*a* are formed in the central area 210 to extend radially from a center C of the central area 210 to the peripheral area 220. The central area 210 is equally divided by the dividing lines 210*a*. The equally divided central area 210 can have a shape that is substantially a sector of the circle defined by central area 210.

A plurality of acoustic holes 230 are formed by penetrating through the central area 210 in a vertical direction. The acoustic holes 230 may be spaced apart from each other by the same interval.

In an example embodiment, the central area 210 may be divided into three by the dividing lines 210*a*. Therefore, the dividing lines 210*a* may form an angle of 120 degrees each other with respect to the center C.

In addition, the acoustic holes 230 disposed in the equally divided areas of the central area 210 may be rotationally symmetrical with respect to the center C. Therefore, an arrangement of the acoustic holes 230 in any one area of the equally divided areas is identical to an arrangement in which the acoustic holes 230 of adjacent area is rotated 120 degrees with respect to the center C.

In particular, referring to FIG. 9, the acoustic holes 230 may have a rhomboid shape and may have the same size as each other. The opposite angles of the acoustic holes 230 may be 60 degrees and 120 degrees, though other angles can be used.

The acoustic holes 230 may be arranged to form a lattice shape. Here, the acoustic holes 230 may be arranged at the same angle as the opposite angle of the acoustic holes 230.

Figure 10:
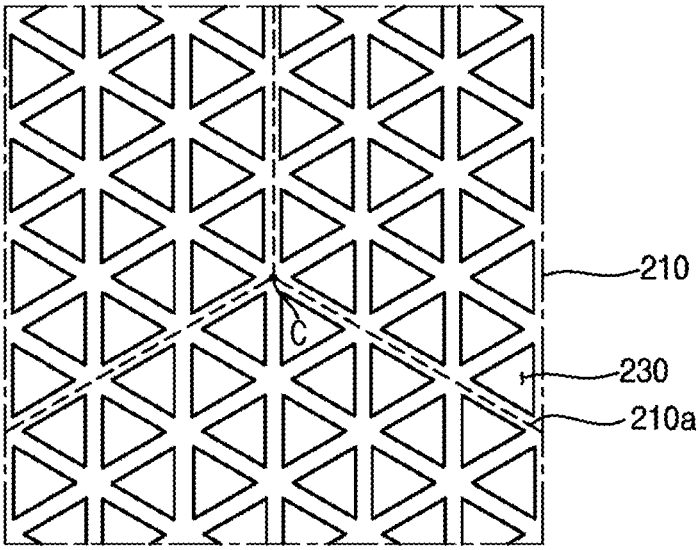
FIGS. 10 to 16 are enlarged views illustrating alternate embodiments of the central area of the back plate shown in FIG. 8.

Referring to FIG. 10, the acoustic holes 230 may have a regular triangular shape and may have the same size as each other. When the acoustic holes 230 have a regular triangular shape, six adjacent acoustic holes 230 may be arranged to form a substantially hexagonal shape.

Figure 11:
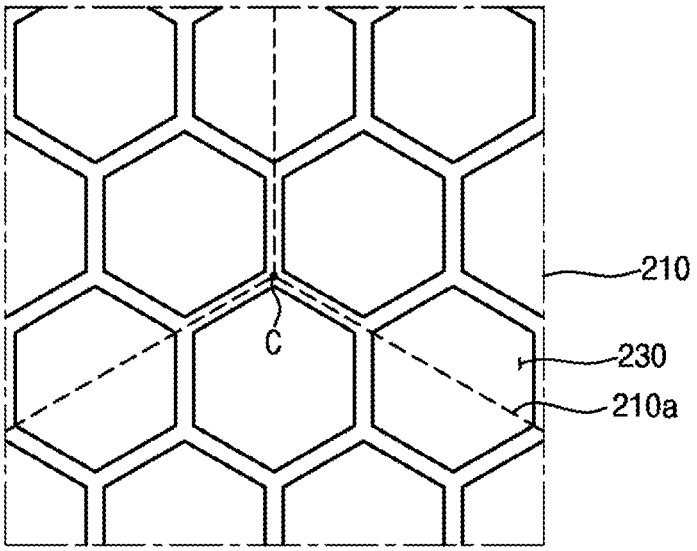

Referring to FIG. 11, the acoustic holes 230 may have a regular hexagonal shape and may have the same size as each other. When the acoustic holes 230 have a regular hexagonal shape, the acoustic holes 230 may be arranged to form a honeycomb shape.

Referring to FIG. 12, the acoustic holes 230 may include both holes 231 having regular hexagonal shapes and holes 233 having regular triangular shapes. The regular hexagonal holes 231 may have the same size as each other, and the regular triangle-shaped holes 233 may have the same size as each other. The regular hexagonal holes 231 and the regular triangle-shaped holes 233 may have different sizes.

The regular hexagonal holes 231 may be disposed so that vertices of the regular hexagonal holes 231 are adjacent to each other, and one regular triangular hole 233 may be disposed among three adjacent regular hexagonal holes 231.

Figure 13:
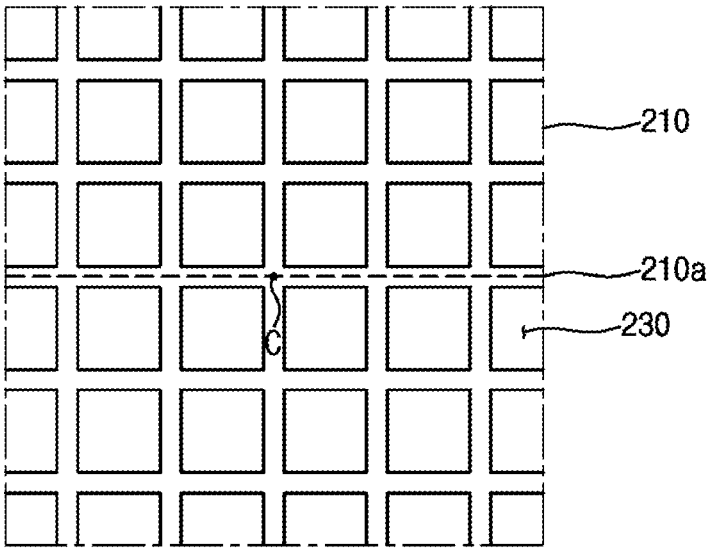

In an example embodiment, the central area 210 may be divided into two by the dividing lines 210*a* as shown in FIG. 13. Therefore, the dividing lines 210*a* may form an angle of 180 degrees each other with respect to the center C.

In addition, the acoustic holes 230 disposed in the equally divided areas of the central area 210 may be rotationally symmetrical with respect to the center C. Therefore, an arrangement of the acoustic holes 230 in any one area of the equally divided areas is identical to an arrangement in which the acoustic holes 230 of another area is rotated 180 degrees with respect to the center C.

In particular, referring to FIG. 13, the acoustic holes 230 may have a regular square shape and may have the same size as each other. The acoustic holes 230 may be arranged to form a lattice shape.

Figure 14:
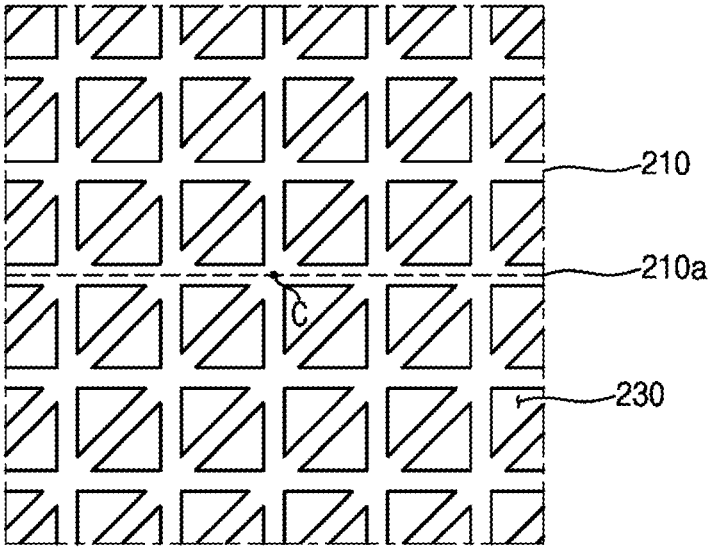

Referring to FIG. 14, the acoustic holes 230 may have a right triangular shape and may have the same size as each other. When the acoustic holes 230 have a right triangular shape, two adjacent acoustic holes 230 may be disposed to form a substantially regular square shape.

Figure 15:
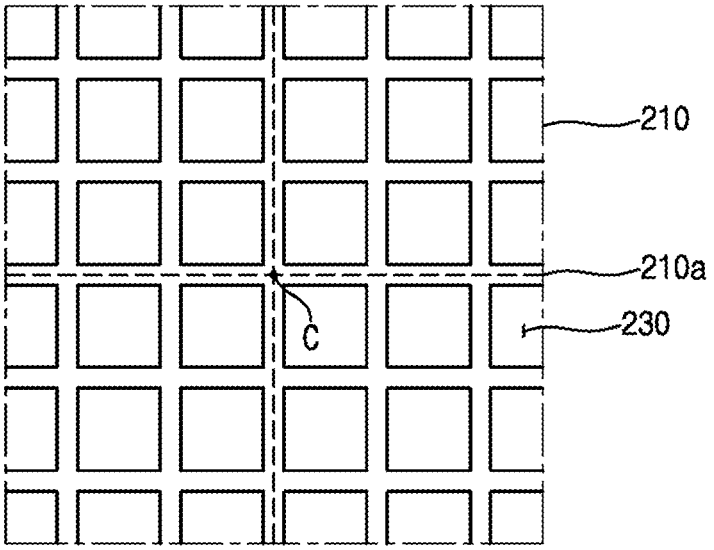

In an example embodiment, the central area 210 may be divided into four by the dividing lines 210*a* as shown in FIG. 15. Therefore, the dividing lines 210*a* may form an angle of 90 degrees each other with respect to the center C.

In addition, the acoustic holes 230 disposed in the equally divided areas of the central area 210 may be rotationally symmetrical with respect to the center C. Therefore, an arrangement of the acoustic holes 230 in any one area of the equally divided areas is identical to an arrangement in which the acoustic holes 230 of adjacent area is rotated 90 degrees with respect to the center C.

In particular, referring to FIG. 15, the acoustic holes 230 may have a regular square shape and may have the same size as each other. The acoustic holes 230 may be arranged to form a lattice shape.

Figure 16:
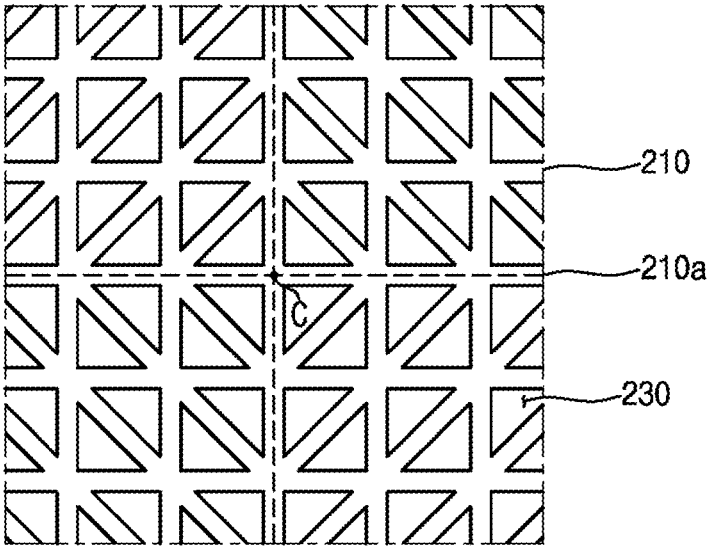

Referring to FIG. 16, the acoustic holes 230 may have a right triangular shape and may have the same size as each other. When the acoustic holes 230 have a right triangular shape, two adjacent acoustic holes 230 may be disposed to form a substantially regular square shape.

Though not shown in detail in figures, the central area 210 may be equally divided into five or more by the dividing lines 210*a*.

As illustrated in FIGS. 8 to 16, the acoustic holes 230 are disposed in a lattice form to be spaced apart from each other by the same interval, thereby an area between the acoustic holes 230 may be minimized. Therefore, an area of the acoustic holes 230 may be increased in the total area of the central area 210 as compared with the related art. In particular, when the acoustic holes 230 have the same size as each other, the area of the acoustic holes 230 may be further increased relatively.

In addition, since the acoustic holes 230 are arranged to be symmetric with respect to the center C, sagging of the central area 210 may be radially uniform with respect to the center C even if the sagging of the central area 210 occurs due to the acoustic holes 230. Accordingly, the diaphragm disposed to face the back plate 200 may also vibrate uniformly radially with respect to the center C.

Figure 17:
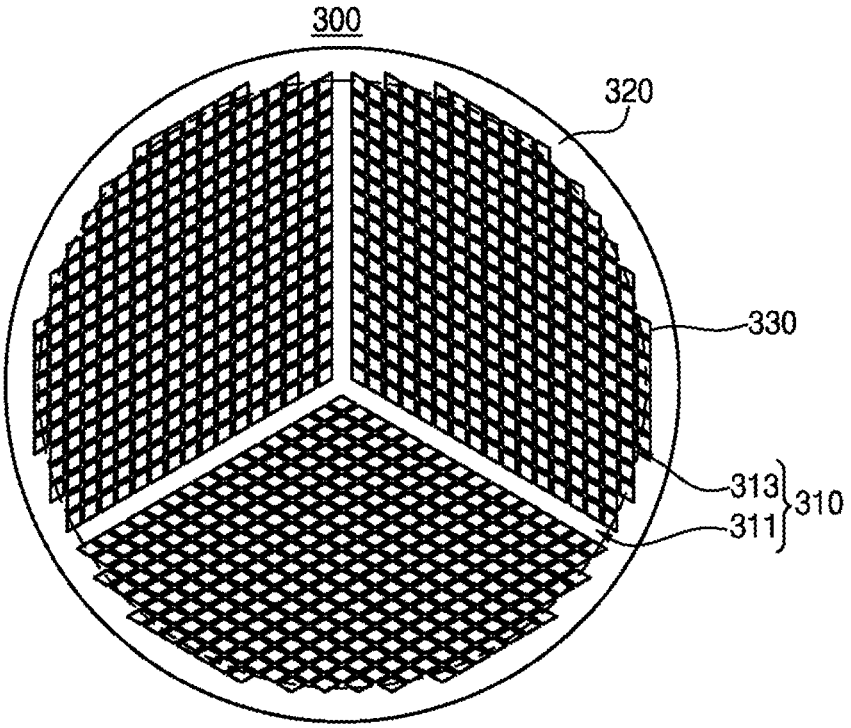
FIG. 17 is a plan view illustrating a back plate in accordance with another example embodiment of the present disclosure.
Figure 18:
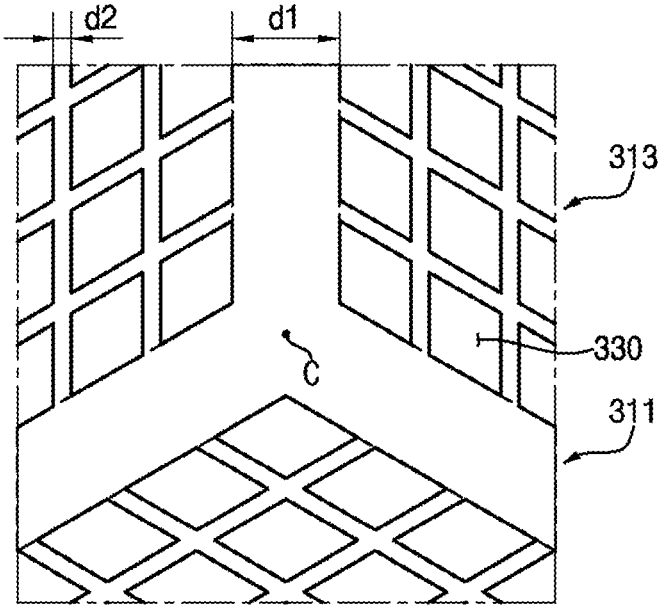
FIG. 18 is an enlarged view illustrating the central area of the back plate shown in FIG. 17, according to an embodiment.

FIG. 17 is a plan view illustrating a back plate in accordance with another example embodiment of the present disclosure, FIG. 18 is an enlarged view illustrating an embodiment of the central area of the back plate shown in FIG. 17, and FIGS. 19 to 25 are enlarged views illustrating alternate embodiments of the central area of the back plate shown in FIG. 17.

Referring to FIGS. 17 to 25, a back plate 300 is disposed in a vibration area of a MEMS microphone. The back plate 300 may be disposed to face a diaphragm. In an example embodiment, the back plate 300 may be substantially disc shaped.

The back plate 300 may be divided into a central area 310 and a peripheral area 320. The central area 310 is located at a central portion of the back plate 300 and has a substantially circular shape. The peripheral area 320 includes an area of the back plate 300 except for the central area 310 and has a ring shape surrounding the central area 310.

The central area 310 may include support areas 311 and hole areas 313. The support areas 311 may extend radially from a center C of the central area 310 to the peripheral area 320 so as to equally divide the central area 310.

The hole areas 313 include an area excluding the support areas 311 from the central area 310. The hole areas 313 may be equally divided by the support areas 311. The hole areas 313 may be substantially shaped as sectors of a circle defined by central areas 310.

A plurality of acoustic holes 330 are formed by penetrating through the hole areas 313 in a vertical direction. The acoustic holes 330 may be spaced apart from each other by the same interval.

A width d1 of the support areas 311 may be wider than an interval d2 between the acoustic holes 330. Thus, the support areas 311 may stably support the central area 310. Therefore, even if the acoustic holes 330 are formed in the central area 310, a sagging of the central area 310 may be reduced.

In an example embodiment, the hole areas 313 may be equally divided into three by the support areas 311. Here, the support areas 311 may form an angle of 120 degrees each other with respect to the center C.

In addition, the acoustic holes 330 disposed in the equally divided hole areas 313 may be rotationally symmetrical with respect to the center C. Therefore, an arrangement of the acoustic holes 330 in any one area of the equally divided hole areas 313 is identical to an arrangement in which the acoustic holes 330 of adjacent area is rotated 120 degrees with respect to the center C.

In particular, referring to FIG. 18, the acoustic holes 330 may have a rhomboid shape and may have the same size as each other. The opposite angle of the acoustic holes 330 may be 60 degrees and 120 degrees. The acoustic holes 330 may be arranged to form a lattice shape. Here, the acoustic holes 330 may be arranged at the same angle as the opposite angle of the acoustic holes 330.

Figure 19:
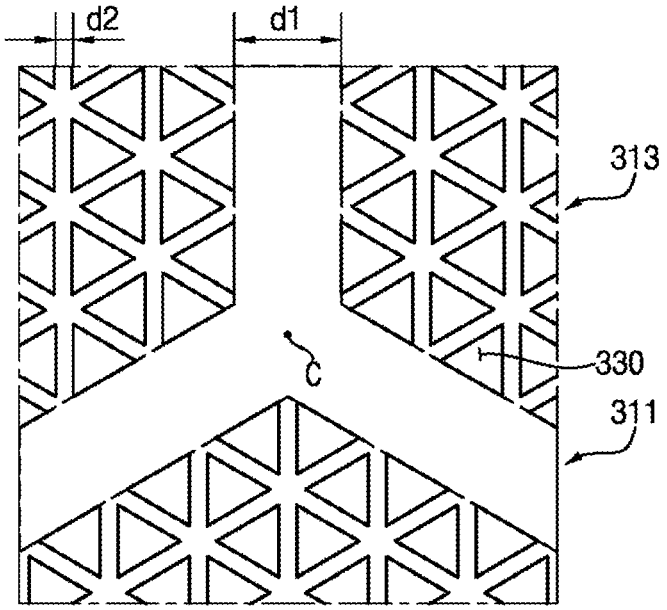
FIGS. 19 to 25 are enlarged views illustrating alternate embodiments of the central area of the back plate shown in FIG. 17.

Referring to FIG. 19, the acoustic holes 330 may have a regular triangular shape and may have the same size as each other. When the acoustic holes 330 have a regular triangular shape, six adjacent acoustic holes 330 may be arranged to form a substantially hexagonal shape.

Figure 20:
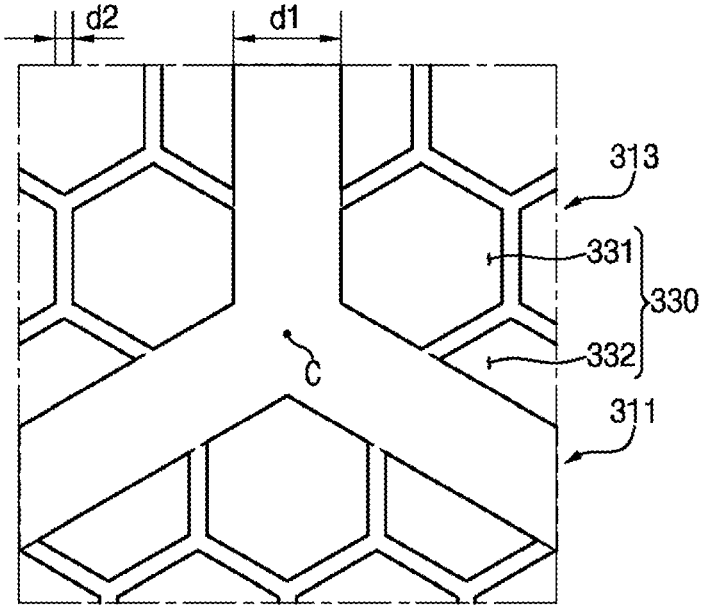

Referring to FIG. 20, the acoustic holes 330 may include regular hexagonal holes 331 and half regular hexagonal holes 332 in which the regular hexagonal holes 331 are bisected.

The regular hexagonal holes 331 may have the same size as each other, and the half regular hexagonal holes 332 may have the same size as each other. The half regular hexagonal holes 332 may be half the size of the regular hexagonal shaped holes 331.

The regular hexagonal holes 331 may be arranged to form a honeycomb shape. The half hexagonal holes 332 may be disposed between the regular hexagonal holes 331 along boundaries of the support areas 311.

Figure 21:
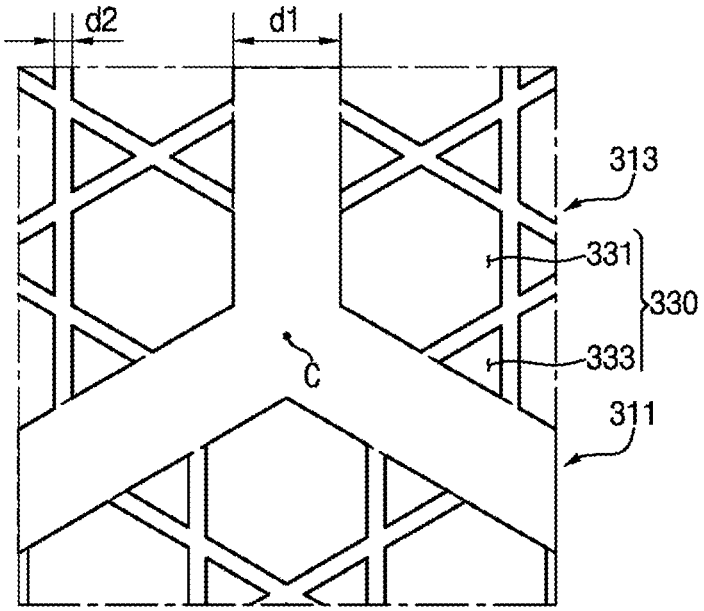

Referring to FIG. 21, the acoustic holes 330 may include holes 331 having regular hexagonal shapes and holes 333 having regular triangular shapes.

The regular hexagonal holes 331 may have the same size as each other, and the regular triangle-shaped holes 333 may have the same size as each other. The regular hexagonal holes 331 and the regular triangle-shaped holes 333 may have different sizes.

The regular hexagonal holes 331 may be disposed so that vertices of the regular hexagonal holes 331 are adjacent to each other, and one regular triangular hole 333 may be disposed among three adjacent regular hexagonal holes 331.

In an example embodiment, the hole areas 313 may be equally divided into two by the support areas 311. Here, the support areas 311 may form an angle of 180 degrees each other with respect to the center C.

In addition, the acoustic holes 330 disposed in the equally divided hole areas 313 may be rotationally symmetrical with respect to the center C. Therefore, an arrangement of the acoustic holes 330 in any one area of the equally divided hole areas 313 is identical to an arrangement in which the acoustic holes 330 of another area is rotated 180 degrees with respect to the center C.

Figure 22:
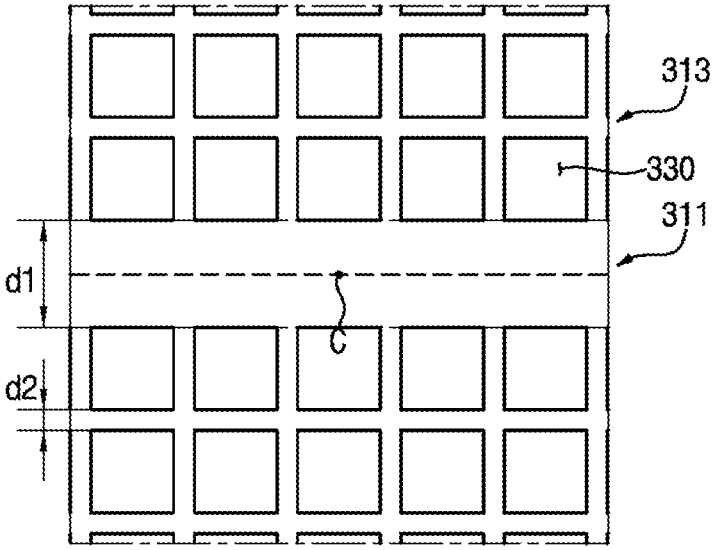

In particular, referring to FIG. 22, the acoustic holes 330 may have a regular square shape and may have the same size as each other. The acoustic holes 330 may be arranged to form a lattice shape.

Figure 23:
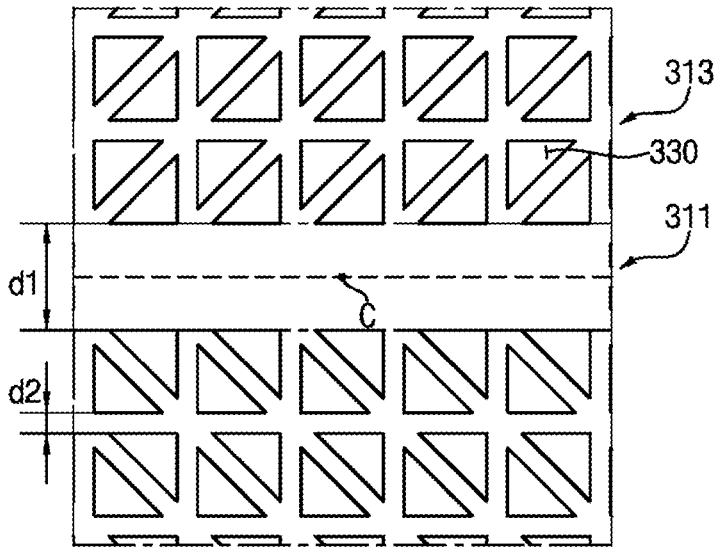

Referring to FIG. 23, the acoustic holes 330 may have a right triangular shape and may have the same size as each other. When the acoustic holes 330 have a right triangular shape, two adjacent acoustic holes 330 may be disposed to form a substantially regular square shape.

In an example embodiment, the hole areas 313 may be equally divided into four by the support areas 311. Here, the support areas 311 may form an angle of 90 degrees each other with respect to the center C.

In addition, the acoustic holes 330 disposed in the equally divided hole areas 313 may be symmetrical with respect to the center C. Therefore, an arrangement of the acoustic holes 330 in any one area of the equally divided hole areas 313 is identical to an arrangement in which the acoustic holes 330 of adjacent area is rotated 90 degrees with respect to the center C.

Figure 24:
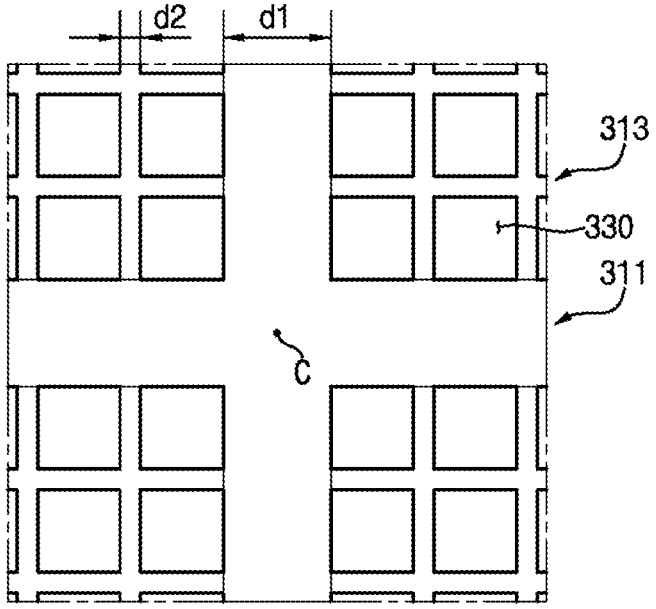

In particular, referring to FIG. 24, the acoustic holes 330 may have a regular square shape and may have the same size as each other. The acoustic holes 330 may be arranged to form a lattice.

Figure 25:
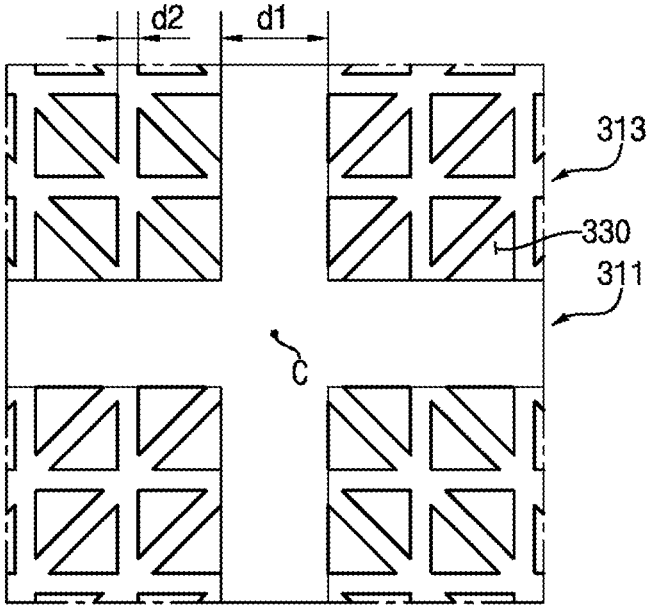

Referring to FIG. 25, the acoustic holes 330 may have a right triangular shape and may have the same size as each other. When the acoustic holes 330 have a right triangular shape, two adjacent acoustic holes 330 may be disposed to form a substantially regular square shape.

Though not shown in detail in figures, the hole areas 313 may be equally divided into five or more by the support areas 311 in embodiments.

As illustrated in FIGS. 17 to 25, the acoustic holes 330 are disposed be spaced apart from each other by the same interval, thereby an area between the acoustic holes 330 may be minimized. Therefore, an area of the acoustic holes 330 may be increased in the total area of the central area 310 as compared with conventional arrangements.

In addition, since the acoustic holes 330 are arranged to be symmetric with respect to the center C, the sagging of the central area 310 may be radially uniform with respect to the center C even if the sagging of the central area 310 occurs due to the acoustic holes 330. Accordingly, the diaphragm disposed to face the back plate 300 may also vibrate uniformly radially with respect to the center C.

Figure 26:
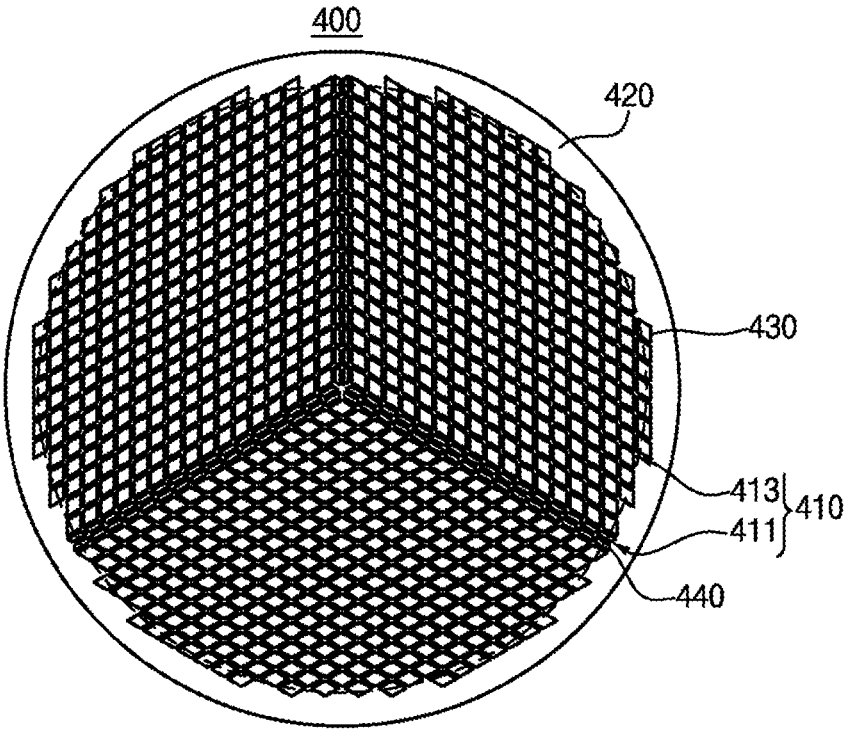
FIG. 26 is a plan view illustrating a back plate in accordance with another example embodiment of the present disclosure.
Figure 27:
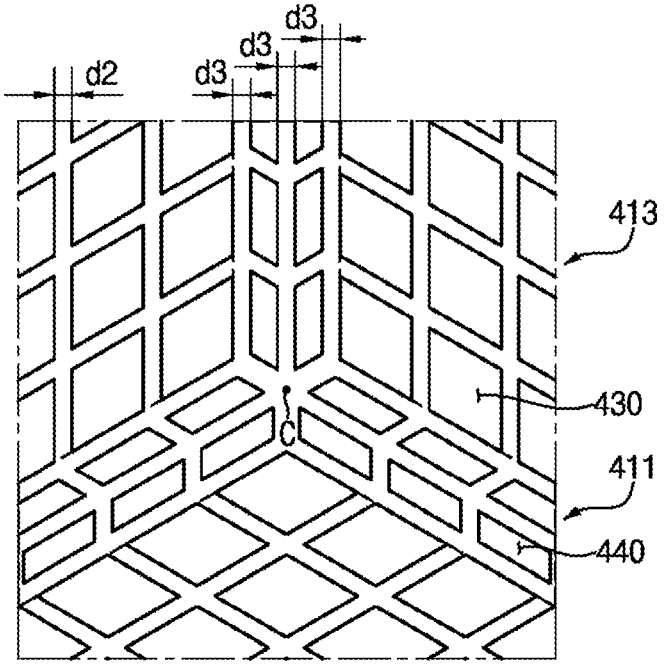
FIG. 27 is an enlarged view illustrating the central area of the back plate shown in FIG. 26, according to an embodiment.

FIG. 26 is a plan view illustrating a back plate in accordance with another example embodiment of the present disclosure, FIG. 27 is an enlarged view illustrating an embodiment the central area of the back plate shown in FIG. 26, and FIGS. 28 to 34 are enlarged views illustrating alternate embodiments of the central area of the back plate shown in FIG. 26.

Referring to FIGS. 26 to 34, a back plate 400 is disposed in a vibration area of a MEMS microphone. The back plate 400 may be disposed to face a diaphragm. In an example embodiment, the back plate 400 may be substantially disc shaped.

The back plate 400 may be divided into a central area 410 and a peripheral area 420.

The central area 410 is located at a central portion of the back plate 400 and has a substantially circular shape.

The peripheral area 420 includes an area of the back plate 400 except for the central area 410 and has a ring shape surrounding the central area 410.

The central area 410 may include support areas 411 and hole areas 413.

The support areas 411 may extend radially from a center C of the central area 410 to the peripheral area 420 so as to equally divide the central area 410.

The hole areas 413 include an area excluding the support areas 411 from the central area 410. The hole areas 413 may be equally divided by the support areas 411. The hole areas 413 have a substantially sector shape.

A plurality of acoustic holes 430 are formed by penetrating through the hole areas 413 in a vertical direction. The acoustic holes 430 may be spaced apart from each other by the same interval.

A plurality of second acoustic holes 440 are formed by penetrating through the support area 411 in a vertical direction. The second acoustic holes 440 may have various shapes such as a rhomboid shape, a regular triangular shape, a regular hexagonal shape, a regular square shape, a rectangular shape, and a circle shape. In an example embodiment, the second acoustic holes 440 may be any one of the various shapes, or may be mixed with at least two of the various shapes.

A size of the second acoustic holes 440 may be smaller than a size of the acoustic holes 430, and an interval d3 between the second acoustic holes 440 and an interval d3 between the acoustic holes 430 and the second acoustic holes 440 may be equal to or wider than an interval d2 between the acoustic holes 430.

Alternatively, a size of the second acoustic holes 440 may be the same as the size of the acoustic holes 430, and the interval d3 between the second acoustic holes 440 and the interval d3 between the acoustic holes 430 and the second acoustic holes 440 may be equal to or wider than the interval d2 between the acoustic holes 430.

Even if the second acoustic holes 440 are formed in the support areas 411, the support areas 411 may stably support the central area 410. Therefore, even if the acoustic holes 430 and the second acoustic holes 440 are formed in the central area 410, sagging of the central area 410 may be prevented.

In an example embodiment, the hole areas 413 may be equally divided into three by the support areas 411. Here, the support areas 411 may form an angle of 120 degrees each other with respect to the center C.

In addition, the acoustic holes 430 disposed in the equally divided hole areas 413 may be symmetrical with respect to the center C. Therefore, an arrangement of the acoustic holes 430 in any one area of the equally divided hole areas 413 is identical to an arrangement in which the acoustic holes 430 of adjacent area is rotated 120 degrees with respect to the center C.

In particular, referring to FIG. 27, the acoustic holes 430 may have a rhomboid shape and may have the same size as each other. The opposite angles of the acoustic holes 430 may be 60 degrees and 120 degrees.

The acoustic holes 430 may be arranged to form a lattice shape. Here, the acoustic holes 430 may be arranged at the same angle as the opposite angle of the acoustic holes 430.

Figure 28:
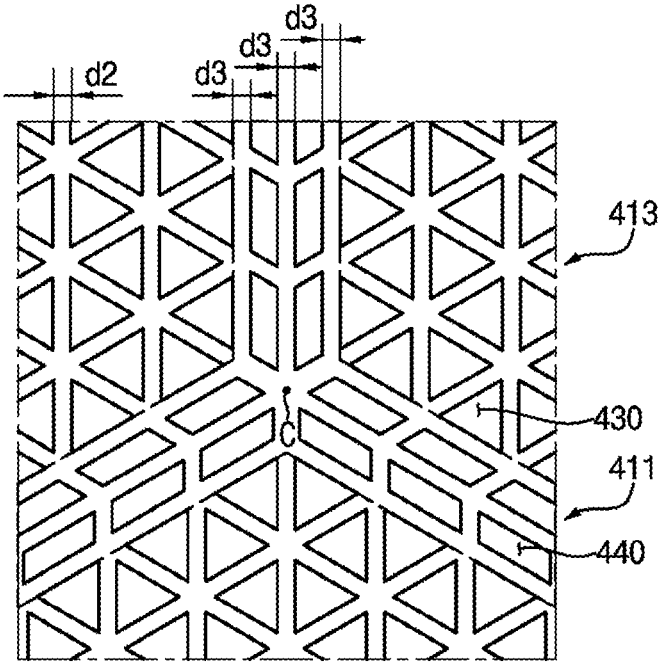
FIGS. 28 to 34 are enlarged views illustrating alternate embodiments of the central area of the back plate shown in FIG. 27.

Referring to FIG. 28, the acoustic holes 430 may have a regular triangular shape and may have the same size as each other. When the acoustic holes 430 have a regular triangular shape, six adjacent acoustic holes 430 may be arranged to form a substantially hexagonal shape.

Figure 29:
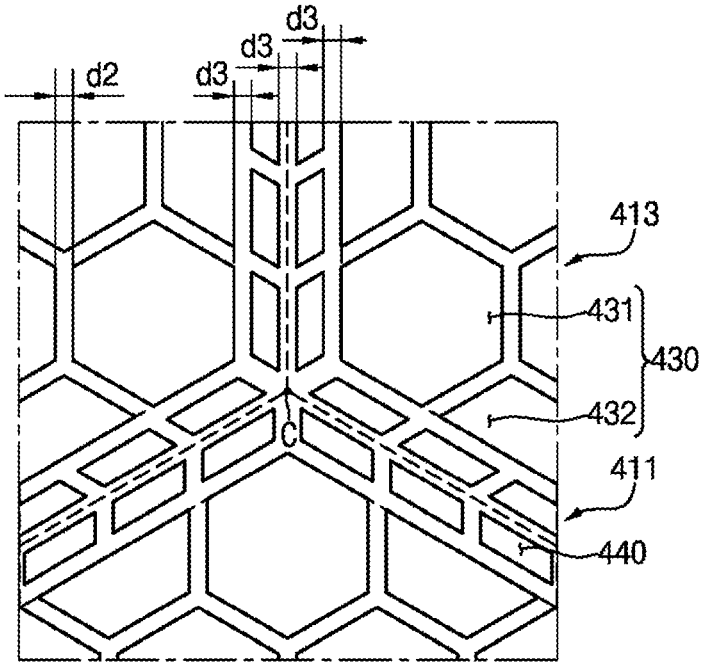

Referring to FIG. 29, the acoustic holes 430 may include regular hexagonal holes 431 and half regular hexagonal holes 432 in which the regular hexagonal holes 431 are bisected.

The regular hexagonal holes 431 may have the same size as each other, and the half regular hexagonal holes 432 may have the same size as each other. The half regular hexagonal holes 432 may be half size of the regular hexagonal shaped holes 431.

The regular hexagonal holes 431 may be arranged to form a honeycomb shape. The half hexagonal holes 432 may be disposed between the regular hexagonal holes 431 along boundaries of the support areas 411.

Figure 30:
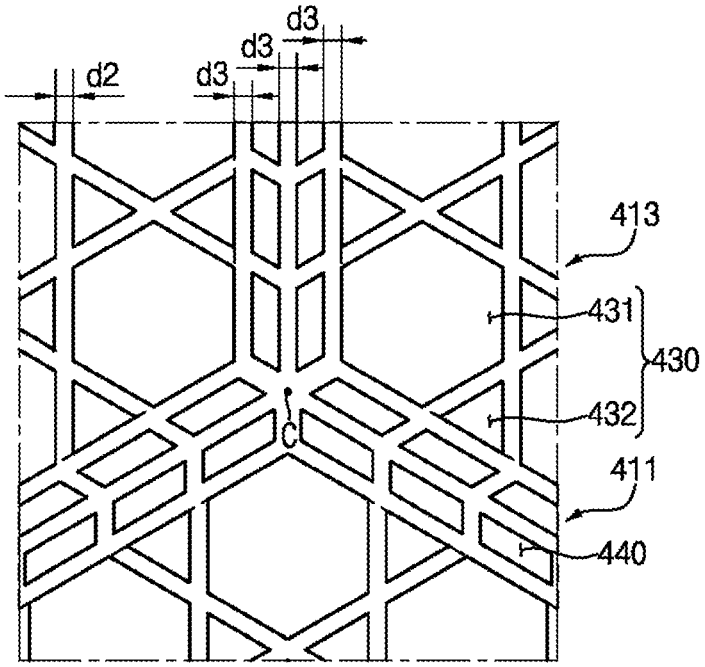

Referring to FIG. 30, the acoustic holes 430 may include holes 431 having regular hexagonal shapes and holes 433 having regular triangular shapes.

The regular hexagonal holes 431 may have the same size as each other, and the regular triangle-shaped holes 433 may have the same size as each other. The regular hexagonal holes 431 and the regular triangle-shaped holes 433 may have different sizes.

The regular hexagonal holes 431 may be disposed so that vertices of the regular hexagonal holes 431 are adjacent to each other, and one regular triangular hole 433 may be disposed among three adjacent regular hexagonal holes 431.

In an example embodiment, the hole areas 413 may be equally divided into two by the support areas 411. Here, the support areas 411 may form an angle of 180 degrees each other with respect to the center C.

In addition, the acoustic holes 430 disposed in the equally divided hole areas 413 may be rotationally symmetrical with respect to the center C. Therefore, an arrangement of the acoustic holes 430 in any one area of the equally divided hole areas 413 is identical to an arrangement in which the acoustic holes 430 of another area is rotated 180 degrees with respect to the center C.

Figure 31:
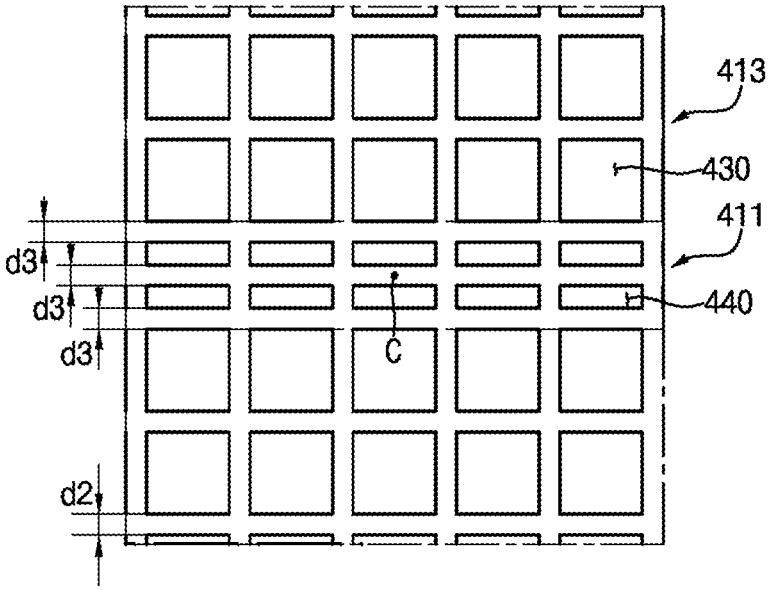

In particular, referring to FIG. 31, the acoustic holes 430 may have a regular square shape and may have the same size as each other. The acoustic holes 430 may be arranged to form a lattice shape.

Figure 32:
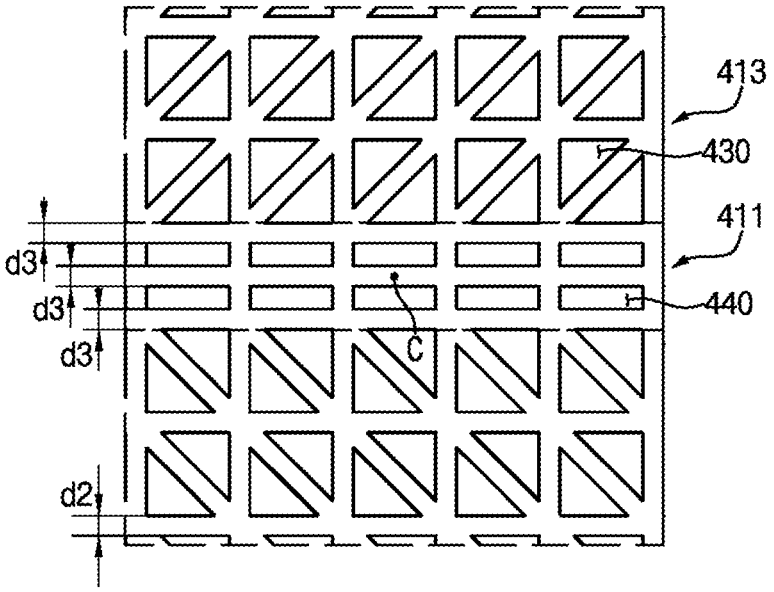

Referring to FIG. 32, the acoustic holes 430 may have a right triangular shape and may have the same size as each other. When the acoustic holes 430 have a right triangular shape, two adjacent acoustic holes 430 may be disposed to form a substantially regular square shape.

In an example embodiment, the hole areas 413 may be equally divided into four by the support areas 411. Here, the support areas 411 may form an angle of 90 degrees each other with respect to the center C.

In addition, the acoustic holes 430 disposed in the equally divided hole areas 413 may be symmetrical with respect to the center C. Therefore, an arrangement of the acoustic holes 430 in any one area of the equally divided hole areas 413 is identical to an arrangement in which the acoustic holes 430 of adjacent area is rotated 90 degrees with respect to the center C.

Figure 33:
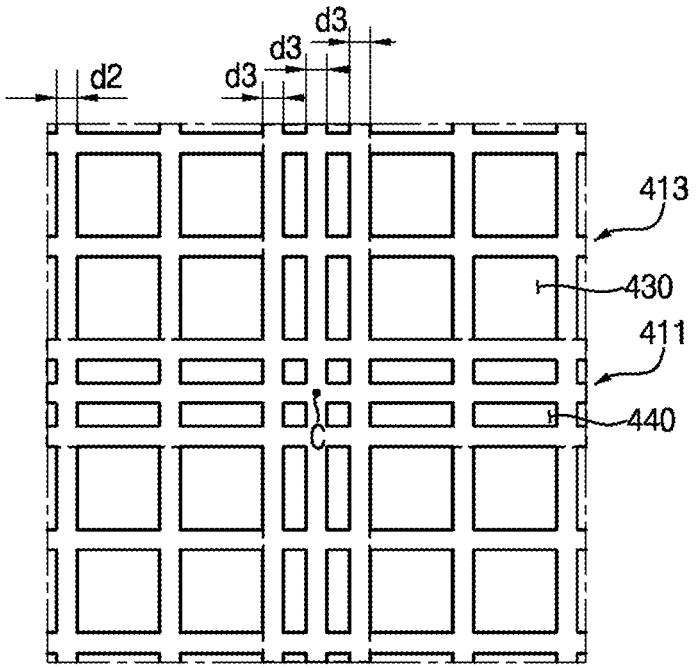

In particular, referring to FIG. 33, the acoustic holes 430 may have a regular square shape and may have the same size as each other. The acoustic holes 430 may be arranged to form a lattice shape.

Figure 34:
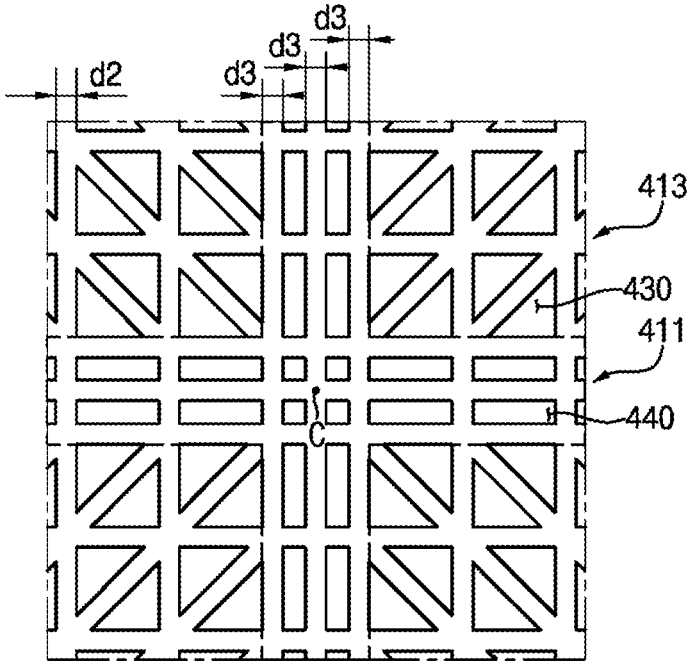

Referring to FIG. 34, the acoustic holes 430 may have a right triangular shape and may have the same size as each other. When the acoustic holes 430 have a right triangular shape, two adjacent acoustic holes 430 may be disposed to form a substantially regular square shape.

Though not shown in detail in figures, the hole areas 413 may be equally divided into five or more by the support areas 411.

As illustrated in FIGS. 26 to 34, the acoustic holes 430 are disposed be spaced apart from each other by the same interval, thereby an area between the acoustic holes 430 may be minimized. Therefore, an area of the acoustic holes 430 may be increased in the total area of the central area 410 as compared with the related art.

In addition, since the acoustic holes 430 are arranged to be symmetric with respect to the center C, the sagging of the central area 410 may be radially uniform with respect to the center C even if the sagging of the central area 410 occurs due to the acoustic holes 430. Accordingly, the diaphragm disposed to face the back plate 400 may also vibrate uniformly radially with respect to the center C.

Figure 35:
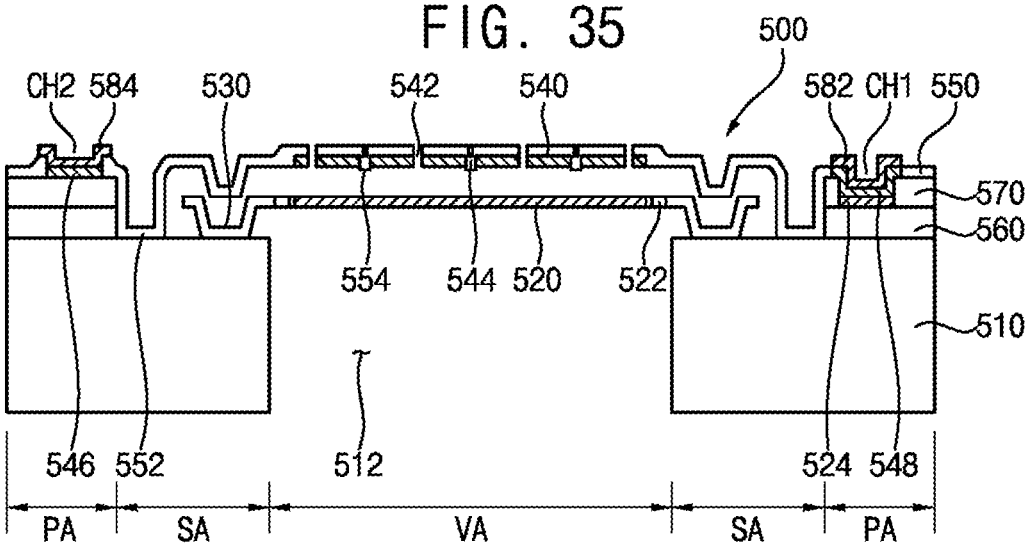
FIG. 35 is a plan view illustrating a MEMS microphone in accordance with an example embodiment of the present disclosure.

FIG. 35 is a plan view illustrating a MEMS microphone in accordance with an example embodiment of the present disclosure.

Referring to FIG. 35, a MEMS microphone 500 in accordance with an example embodiment of the present disclosure is capable of creating a displacement in response to an applied acoustic pressure to convert an acoustic wave into an electrical signal and output the electrical signal. The MEMS microphone 500 includes a substrate 510, a diaphragm 520, an anchor 530 and a back plate 540.

The substrate 510 is divided into a vibration area VA, a supporting area SA surrounding the vibration area VA, and a peripheral area PA surrounding the supporting area SA. In the vibration area VA of the substrate 510, a cavity 512 is formed to provide a space into which the diaphragm 520 is bendable due to the acoustic pressure. The cavity 512 is defined by a cavity wall.

In an example embodiment, the cavity 512 may have a cylindrical shape. Further, the cavity 512 may be formed in the vibration area VA to have a shape and a size corresponding to those of the vibration area VA.

The diaphragm 520 may be disposed over the substrate 510. The diaphragm may generate a displacement which may occur due to the acoustic pressure. The diaphragm 520 may have a membrane structure. The diaphragm 520 may cover the cavity 512. The diaphragm 520 may have a lower surface that is exposed through the cavity 512. The diaphragm 520 is bendable in response to applied acoustic pressure, and the diaphragm 520 is spaced apart from the substrate 510.

The diaphragm 520 may have a doped portion which is doped with impurities through an ion implantation process. The doped portion may be positioned to correspond to the back plate 540. In an example embodiment, the diaphragm 520 may have a shape of a circular disc.

The anchor 530 is positioned at an end portion of the diaphragm 520. The anchor 530 may extend along a circumference of the diaphragm 520. Therefore, the anchor 530 may have a ring shape and may surround the cavity 512.

The anchor 530 is positioned in the supporting area SA of the substrate 510. The anchor 530 supports the diaphragm 520. The anchor 530 may extend from a periphery of the diaphragm 520 toward the substrate 510 to space the diaphragm 520 from the substrate 510.

In an example embodiment of the present disclosure, the anchor 530 may be integrally formed with the diaphragm 520. The anchor 530 may have the lower surface to make contact with the upper surface of the substrate 510.

In an example embodiment of the present disclosure, though not shown in detail in figures, the anchor 530 may be provided in plural along the circumference of the diaphragm 520. The anchors 530 may have columnar shapes spaced apart from each other. Each of the anchors 530 may have a U-shaped vertical section. In particular, an empty space is formed between two anchors adjacent to each other among the anchors 530 so that the space may serve as a passage through which the acoustic pressure moves.

In addition, the diaphragm 520 may have a plurality of vent holes 522. The vent holes 522 may be arranged along the anchor 530 in a ring shape and may be spaced apart from one another. The vent holes 522 are formed by penetrating through the diaphragm 520 in a vertical direction, and are located about a circle having a diameter smaller than the inner diameter of the anchor 530 (i.e., positions inside of the anchor 530 in a horizontal direction). The vent holes 522 are positioned in the supporting area SA. Each of the vent holes 522 may serve as a passage for the applied acoustic wave. Further, each of the vent holes 522 may also function as a passage for the etchant to be used in the process of manufacturing the MEMS microphone 500.

The vent holes 522 may be positioned in the vibration area VA. Alternatively, the vent holes 522 may be positioned in a boundary area between the vibration area VA and the supporting area SA or in the supporting area SA adjacent to the vibration area VA.

The back plate 540 may be disposed over the diaphragm 520. The back plate 540 may be disposed in the vibration area VA to face the diaphragm 520. The back plate 540 may have a doped portion which is formed by doping impurities through an ion implantation process. The back plate 540 may have a shape of a circular disc in embodiments. The back plate 540 may include a plurality of acoustic holes 542 through which the acoustic waves pass.

A detailed description of the back plate 540 may be substantially the same as a description of the back plate with reference to FIGS. 1 to 34. Therefore, an area of the acoustic holes 542 in the back plate 540 may be increased.

In an example embodiment, the MEMS microphone 500 may further include an upper insulation layer 550 and a strut 552 for supporting the back plate 540.

In embodiments, the upper insulation layer 550 is positioned over the substrate 510 over which the back plate 540 is positioned. The upper insulation layer 550 may cover the back plate 540 to hold the back plate 540. Thus, the upper insulation layer 550 may space the back plate 540 from the diaphragm 520. The back plate 540 and the upper insulation layer 550 are spaced apart from the diaphragm 520 to make the diaphragm 520 freely bendable with responding to the acoustic pressure. Further, an air gap AG is formed between the diaphragm 520 and the back plate 540.

A plurality of acoustic holes 542 may be formed through the back plate 540 such that the acoustic wave may flow or pass through the acoustic holes 542. The acoustic holes 542 may be formed through the upper insulation layer 550 and the back plate 540 to communicate with the air gap AG.

The back plate 540 may include a plurality of dimple holes 544. Further, a plurality of dimples 554 may be positioned in the dimple holes 544. The dimple holes 544 may be formed through the back plate 540. The dimples 554 may be positioned to correspond to positions at which the dimple holes 544 are formed.

The dimples 554 may protrude toward the diaphragm 520 from a lower surface of the back plate 540. The dimples 554 may prevent the diaphragm 520 from being coupled to a lower face of the back plate 540, inhibiting a known issue of conventional MEMS microphones.

When acoustic pressure is applied to the diaphragm 520, the diaphragm 520 can be bent in a generally semispherical or paraboloid shape toward the back plate 540, and then can return to its initial position. The degree of bending of the diaphragm 520 may vary depending on a magnitude of the applied acoustic pressure and may be increased to such an extent that an upper surface of the diaphragm 520 makes contact with the lower surface of the back plate 540. If the diaphragm 520 is bent so much as to contact the back plate 540, the diaphragm 520 may attach to the back plate 540 and may not return to the initial position. According to example embodiments, the dimples 554 may protrude from the lower surface of the back plate 540 toward the diaphragm 520. Even when the diaphragm 520 is so deformed that the diaphragm 520 contacts the back plate 540, the dimples 554 may keep the diaphragm 520 and the back plate 540 sufficiently separated from each other that the diaphragm 520 is able to return to the initial position.

The strut 552 may be positioned in the supporting area SA and near the boundary between the supporting area SA and the peripheral area PA. The strut 552 may support the upper insulation layer 550 to space the upper insulation layer 550 and the back plate 540 from the diaphragm 520. The strut 552 may extend from a periphery of the upper insulation layer 550 toward the substrate 550. The strut 552 may include a lower surface in contact with the lower surface of the substrate 510.

The strut 552 may be spaced in a radial direction from the diaphragm 520 and may be outwardly positioned away from the anchor 530. The strut 552 may have a ring shape to surround the diaphragm 520.

In an example embodiment, the strut 552 may be integrally formed with the upper insulation layer 550. The strut 552 may have a U-shaped vertical section.

In an example embodiment, the MEMS microphone 500 may further include a lower insulation layer 560, a diaphragm pad 524, an intermediate insulating layer 570, a back plate pad 546, a connection pad 548, a first pad electrode 582 and a second pad electrode 584.

In particular, the lower insulation layer 560 may be disposed on the upper surface of the substrate 510 and under the upper insulation layer 550. The lower insulating layer 560 may be located in the peripheral area PA and may be provided outside the strut 552.

The diaphragm pad 524 may be formed on an upper surface of the lower insulation layer 560. The diaphragm pad 524 may be located in the peripheral area PA. The diaphragm pad 524 may be electrically connected to the diaphragm 520 and may be doped with impurities. Though not shown in detail in figures, a connection portion may be doped with impurities to connect the doped portion of the diaphragm 520 to the diaphragm pad 524.

The intermediate insulating layer 570 may be formed on the lower insulation layer 560 on which the diaphragm pad 524 is formed, and under the upper insulation layer 550. The lower insulation layer 560 and the intermediate insulating layer 570 are located in the peripheral area PA, and are disposed outside of the outer perimeter of the strut 552.

Further, the lower insulation layer 560 and the interlayer insulating layer 570 may be formed using a material different from that of the upper insulation layer 550. In an example embodiment, the upper insulating layer 550 may be formed of a nitride such as a silicon nitride material, and the lower insulating layer 560 and the intermediate insulating layer 570 may be formed of an oxide.

The back plate pad 546 may be formed on an upper face of the intermediate insulating layer 570. The back plate pad 546 may be located in the peripheral area PA. The back plate pad 546 may be electrically connected to the back plate 540 and may be doped with impurities by an ion implantation process. Though not shown in detail in figures, a connection portion may be doped with impurities to connect the back plate 540 to the back plate pad 546.

A first contact hole CH1 is located in the peripheral area PA and is formed by penetrating through the upper insulation layer 550 and the interlayer insulating layer 570 to expose the diaphragm pad 524. The first pad electrode 582 makes contact with the diaphragm pad 524 exposed by the first contact hole CH1.

Further, a second contact hole CH2 is located in the peripheral area PA and is formed by penetrating through the upper insulation layer 550 to expose the back plate pad 546. The second pad electrode 584 is formed in the second contact hole CH2 to make contact with the back plate pad 546 exposed by the second contact hole CH2.

The connection pad 548 may be located in the peripheral area PA and may be provided inside the first contact hole CH1. In particular, the connection pad 548 may be formed along an upper surface of the vibration pad 524, a sidewall of the intermediate insulating layer 570, and a sidewall of the upper insulating layer 550. Therefore, the connection pad 548 may have a concave shape. The connection pad 548 may be doped with impurities through ion implantation process and may be electrically connected to the vibration pad 524.

The first pad electrode 582 may be disposed on the connection pad 548 in the peripheral area PA. Thus, the first pad electrode 582 may be electrically connected to the vibration pad 524 through the connection pad 548.

The second pad electrode 584 may be located over the back plate pad 546 in the peripheral area PA, and may be electrically connected to the back plate pad 526.

As described above, the MEMS microphone 500 according to example embodiments of the present disclosure includes a strut 552 having a ring shape to surround the diaphragm 520. Therefore, in the manufacturing process of the MEMS microphone 500, the strut 552 may define a moving area of an etchant for removing the intermediate insulating layer 570 and the lower insulating layer 560.

In addition, since the diaphragm 520 has vent holes 522 that can be provided as a passage of the acoustic wave and the etchant, the acoustic wave may smoothly move and process efficiency may be improved.

Further, as the area of the acoustic hole 542 in the back plate 540 is increased, the SNR of the MEMS microphone 500 may be improved.

Although the back plate and the MEM microphone have been described with reference to the specific embodiments, they are not limited thereto. Therefore, it will be readily understood by those skilled in the art that various modifications and changes can be made thereto without departing from the spirit and scope of the appended claims.

Various embodiments of systems, devices, and methods have been described herein. These embodiments are given only by way of example and are not intended to limit the scope of the claimed inventions. It should be appreciated, moreover, that the various features of the embodiments that have been described may be combined in various ways to produce numerous additional embodiments. Moreover, while various materials, dimensions, shapes, configurations and locations, etc. have been described for use with disclosed embodiments, others besides those disclosed may be utilized without exceeding the scope of the claimed inventions.

Persons of ordinary skill in the relevant arts will recognize that embodiments may comprise fewer features than illustrated in any individual embodiment described above. The embodiments described herein are not meant to be an exhaustive presentation of the ways in which the various features may be combined. Accordingly, the embodiments are not mutually exclusive combinations of features; rather, embodiments can comprise a combination of different individual features selected from different individual embodiments, as understood by persons of ordinary skill in the art. Moreover, elements described with respect to one embodiment can be implemented in other embodiments even when not described in such embodiments unless otherwise noted. Although a dependent claim may refer in the claims to a specific combination with one or more other claims, other embodiments can also include a combination of the dependent claim with the subject matter of each other dependent claim or a combination of one or more features with other dependent or independent claims. Such combinations are proposed herein unless it is stated that a specific combination is not intended. Furthermore, it is intended also to include features of a claim in any other independent claim even if this claim is not directly made dependent to the independent claim.

Moreover, reference in the specification to "one embodiment," "an embodiment," or "some embodiments" means that a particular feature, structure, or characteristic, described in connection with the embodiment, is included in at least one embodiment of the teaching. The appearances of the phrase "in one embodiment" in various places in the specification are not necessarily all referring to the same embodiment.

Any incorporation by reference of documents above is limited such that no subject matter is incorporated that is contrary to the explicit disclosure herein. Any incorporation by reference of documents above is further limited such that no claims included in the documents are incorporated by reference herein. Any incorporation by reference of documents above is yet further limited such that any definitions provided in the documents are not incorporated by reference herein unless expressly included herein.

For purposes of interpreting the claims, it is expressly intended that the provisions of Section 112, sixth paragraph of 35 U.S.C. are not to be invoked unless the specific terms "means for" or "step for" are recited in a claim.

What is claimed is:

1. A back plate disposed in a vibration area of a Micro-Electro-Mechanical Systems (MEMS) microphone, the back plate comprising:

a central area located at a central portion of the back plate and having a plurality of first acoustic holes formed therein, the central area including:

a plurality of support areas radially extending from a center of the central area to the peripheral area to equally divide the central area, the plurality of support areas having a width wider than an interval between the first plurality of acoustic holes to prevent sagging of the central area, a plurality of hole areas divided equally by the plurality of support areas and in which the plurality of first acoustic holes are disposed; and a peripheral area located to surround the central area;

wherein the first plurality of acoustic holes are arranged to be spaced apart from each other by equal intervals and second acoustic holes are formed in the support areas.

2. The back plate of claim 1, wherein the plurality of first acoustic holes have the same size as each other and each of the plurality of first acoustic holes has a shape selected from the group consisting of: a rhomboid shape, an regular triangular shape, a regular hexagonal shape, a regular square shape, and a right triangular shape.

3. The back plate of claim 2, wherein the plurality of first acoustic holes each have a rhomboid shape or a regular square shape and the plurality of first acoustic holes are spaced in a lattice arrangement.

4. The back plate claim 2, wherein the plurality of first acoustic holes each have a regular hexagonal shape and the plurality of first acoustic holes are spaced in a honeycomb arrangement.

5. The back plate of claim 2, wherein the plurality of first acoustic holes comprises at least six acoustic holes, each having a regular triangular shape;

and further wherein the plurality of first acoustic holes are arranged such that each group of six adjacent first acoustic holes are spaced in an approximately regular hexagonal arrangement.

6. A back plate disposed in a vibration area of a Micro-Electro-Mechanical Systems (MEMS) microphone, the back plate comprising:

a central area located at a central portion of the back plate and having a plurality of acoustic holes formed therein; and a peripheral area located to surround the central area, wherein the plurality of acoustic holes are arranged to be spaced apart from each other by equal intervals, and the plurality of acoustic holes comprise at least three first acoustic holes each having a regular hexagonal shape and a plurality of second acoustic holes each having a regular triangular shape, each of the second acoustic holes being disposed among three adjacent first acoustic holes.

7. The back plate of claim 1, wherein the central area is radially and equally divided with respect to a center of the central area into a plurality of segments such that a portion of the plurality of first acoustic holes is arranged in each of the plurality of segments; and further wherein the portion of the plurality of acoustic holes disposed in each segment has an arrangement that is rotationally symmetrical with respect to the center relative to the other portions of the plurality of first acoustic holes.

8. The back plate of claim 7, wherein:

the central area is divided into three segments;

the plurality of first acoustic holes have the same size as each other; and each of the plurality of first acoustic holes has a shape selected from the group consisting of: a rhomboid shape, a regular triangular shape, and a regular hexagonal shape.

9. The back plate of claim 7, wherein the central area is divided into three segments, and the plurality of first acoustic holes have a regular hexagonal shape and a regular triangular shape.

10. The back plate of claim 7, wherein:

the central area is divided into two segments or four segments;

the plurality of first acoustic holes have the same size as each other; and each of the plurality of first acoustic holes has a regular square shape or a right triangular shape.

11. The back plate of claim 1, wherein a size of the second acoustic holes is equal to or smaller than a size of the plurality of first acoustic holes.

12. The back plate of claim 1, wherein an interval between the second acoustic holes and an interval between the plurality of first acoustic holes and the second acoustic holes are equal to or wider than the interval between the plurality of first acoustic holes.

13. The back plate of claim 1, wherein arrangements of the plurality of first acoustic holes disposed in each of the plurality of hole areas are symmetrical with respect to the center of the central area.

14. The back plate of claim 13, wherein:

the plurality of support areas are arranged to form an angle of 120 degrees to each other;

the plurality of first acoustic holes have the same size as each other; and each of the plurality of first acoustic holes has a shape selected from the group consisting of: a rhomboid shape, a regular triangular shape, and a regular hexagonal shape.

15. The back plate of claim 13, wherein the plurality of support areas are arranged to form an angle of 120 degrees to each other, and the plurality of first acoustic holes have a regular hexagonal shape and a regular triangular shape.

16. The back plate of claim 13, wherein:

the plurality of support areas are arranged to form an angle of 90 degrees or 180 degrees to each other;

the plurality of first acoustic holes have the same size as each other; and each of the plurality of first acoustic holes has a regular square shape or a right triangular shape.

17. A Micro-Electro-Mechanical Systems (MEMS) microphone comprising:

a substrate presenting a vibration area, a supporting area surrounding the vibration area and a peripheral area surrounding the supporting area, the substrate defining a cavity formed in the vibration area;

a diaphragm disposed in the vibration area, being spaced apart from the substrate, covering the cavity, and configured to generate a displacement thereof in response to an applied acoustic pressure; and a back plate disposed over the diaphragm in the vibration area, the back plate being spaced apart from the diaphragm such that an air gap is maintained between the back plate and the diaphragm, and defining a plurality of acoustic holes, wherein the back plate includes a central area located at a central portion of the back plate, the plurality of acoustic holes formed in the central area, and a second peripheral area located to surround the central area, wherein the plurality of acoustic holes are arranged to be spaced apart from each other by the same interval, and the central area further includes a plurality of support areas radially extending from a center of the central area to the peripheral area to equally divide the central area, the plurality of support areas having a width wider than an interval between the plurality of acoustic holes to prevent sagging of the central area; and a plurality of hole areas divided equally by the plurality of support areas and in which the plurality of acoustic holes are disposed, and the back plate further includes second acoustic holes formed in the support areas.

* * * * *